US006789741B2

(12) United States Patent
Varanasi et al.

(10) Patent No.: US 6,789,741 B2
(45) Date of Patent: Sep. 14, 2004

(54) METHOD AND APPARATUS FOR ATOMIZING LIQUIDS HAVING MINIMAL DROPLET SIZE

(75) Inventors: Padma P. Varanasi, Racine, WI (US); David C. Bronson, Dodge County, WI (US); Guy D. Daley, Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 279 days.

(21) Appl. No.: 10/107,274

(22) Filed: Mar. 27, 2002

(65) Prior Publication Data

US 2003/0192956 A1 Oct. 16, 2003

(51) Int. Cl.[7] ..... B05B 1/08

(52) U.S. Cl. ..... 239/102.1; 239/4; 239/102.2; 239/548; 347/45; 347/47

(58) Field of Search ..... 239/4, 104, 102.1, 239/102.2, 548; 347/45, 47, 70

(56) References Cited

U.S. PATENT DOCUMENTS

| | | | | |
|---|---|---|---|---|
| 4,605,167 A | * | 8/1986 | Maehara | 239/102.2 |
| 4,667,877 A | * | 5/1987 | Yao et al. | 239/102.2 |
| 5,164,740 A | | 11/1992 | Ivri | 346/1.1 |
| 5,297,734 A | | 3/1994 | Toda | 239/102.2 |
| 5,387,440 A | * | 2/1995 | Takemoto et al. | 427/443.1 |
| 5,502,470 A | * | 3/1996 | Miyashita et al. | 347/45 |
| 5,515,841 A | * | 5/1996 | Robertson et al. | 128/200.16 |
| 5,574,530 A | * | 11/1996 | Sanada | 396/604 |
| 5,586,550 A | | 12/1996 | Ivri et al. | 128/200.16 |
| 5,853,894 A | * | 12/1998 | Brown | 428/422 |
| 6,036,105 A | * | 3/2000 | Sanada et al. | 239/104 |
| 6,231,929 B1 | * | 5/2001 | Milbourn | 427/402 |
| 6,296,136 B1 | | 10/2001 | Huet | 220/233 |

FOREIGN PATENT DOCUMENTS

| | | | |
|---|---|---|---|
| EP | 0 432 992 A1 | 6/1991 | B05B/17/06 |

OTHER PUBLICATIONS

Publication: Al–Suleimani, et al., "How Orderly is Ultrasonic Atomization?", ILASS–Europe '99, pp. 1–6.
Brochure: "NYEBAR Type Q To Prevent Oil Migration", Nye The World Leader in Synthetic Lubrication, 3 pages.

* cited by examiner

*Primary Examiner*—Patrick Brinson

(57) ABSTRACT

An orifice plate is vibrated up and down at high frequency while liquid is delivered to its lower surface so that the liquid is ejected up from the plate in the form of very small diameter droplets. The upper surface of the plate is constructed to resist wetting and buildup of a liquid film thereby to form smaller diameter liquid droplets which are ejected to greater heights. The upper surface of the plate may be treated with a surfactant such as a flurosurfactant.

19 Claims, 2 Drawing Sheets

METHOD AND APPARATUS FOR ATOMIZING LIQUIDS HAVING MINIMAL DROPLET SIZE

BACKGROUND OF THE INVENTION

1. Field of the Invention

This invention relates to the atomization of liquids and in particular it concerns novel methods and apparatus for forming atomized liquid droplets of minimal size.

2. Description of the Related Art

U.S. Pat. No. 5,164,740 describes a vibrating plate atomizing device in which liquid which is supplied to one side of a vibrating orifice plate, passes through orifices in the plate and becomes atomized and ejected from the opposite side of the plate. Other U.S. patents which describe similar devices are U.S. Pat. No. 5,586,550, U.S. Pat. No. 5,297,734 and U.S. Pat. No. 6,296,136 B1.

Such devices may be used to disperse liquids, such as fragrances and insecticides into the atmosphere. When such liquids are formed into small droplets and ejected as droplets into the atmosphere, their high surface area to volume ratio improves their ability to evaporate. While it is preferred that each droplet evaporates entirely before falling back onto an adjacent surface, this does not always happen due to various factors, one being that the size of many of the droplets is so large that they do not have time to fully evaporate before reaching the adjacent surface.

SUMMARY OF THE INVENTION

The present invention helps to minimize the amount of unevaporated liquid from a vibrating plate atomizing device which falls back toward an adjacent surface.

According to one aspect of the invention, there is provided a novel method of generating droplets of minimal diameter by means of a vibratory atomization plate to which a liquid is delivered. This novel method involves the steps of treating the surface of the plate from which droplets are ejected during atomization to minimize liquid accumulation on said surface, and supplying the liquid to the plate while vibrating it to atomize the liquid.

According to a further aspect of the invention, there is provided a novel atomization device for converting a liquid into droplets of minimum diameter and ejecting said droplets into the atmosphere. This novel device comprises an atomization plate coupled to an actuator to be vibrated by the actuator and a liquid supply system arranged to supply liquid to the plate as it is being vibrated. The plate has a surface, from which droplets are ejected, which has been treated to minimize accumulation of liquid.

It has been found that by providing the vibrating plate with a finish on its ejection surface that eliminates or at least minimizes accumulation or buildup of liquid, the plate can eject droplets which are smaller and which are thrown up top a greater height than is possible with vibrating plates having conventional surface finishes.

DETAILED DESCRIPTION OF THE PREFERRED EMBODIMENT

Figure 1:
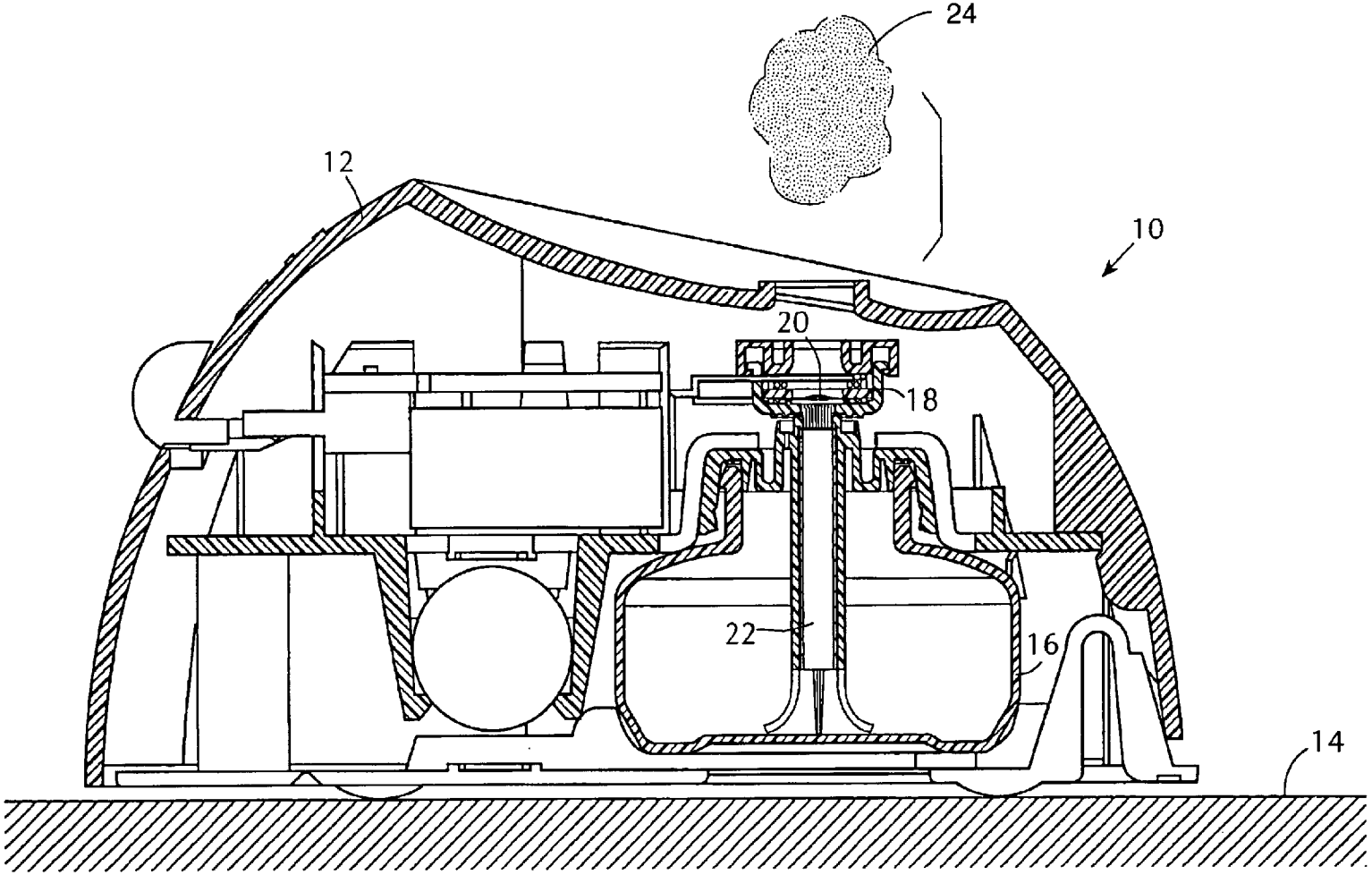
FIG. 1 is a section view taken in elevation showing the interior of a vibratory plate atomization device in which the present invention may be incorporated.

FIG. 1 shows an atomizer device 10 in which the present invention may be used. The atomizer device 10 comprises an outer hollow plastic housing 12 which rests on a surface 14 such as a table top or a shelf A reservoir 16 which contains a liquid to be atomized is mounted in the housing. An atomizing assembly comprising a ring shaped piezoelectric actuator 18 and an orifice plate 20 which extends across and is fixed to the actuator, is mounted in the housing just above the reservoir 16. A liquid delivery system, such as a wick or capillary tube 22 delivers liquid from the reservoir 16 to the underside of the orifice plate while high frequency alternating electrical fields are applied across the piezoelectric actuator 18. This causes the actuator 18 to expand and contract radially and force the orifice plate 20 to vibrate up and down at the high frequency. As the orifice plate moves up and down it causes the liquid from the capillary tube 22 to be forced through tiny orifices in the plate and ejected in the form of minute droplets into the atmosphere in the form of a cloud 24. As the droplets which form the cloud 24 fall back toward the surface 14 they vaporize and are thereby dispersed into the atmosphere.

The specific construction of the atomizer 10 is not part of the invention, which may be used with any vibratory plate atomization device. The particular atomizer shown herein is described in detail in U.S. patent application Ser. No. 09/699,106, filed Oct. 27, 2000.

Figure 2:
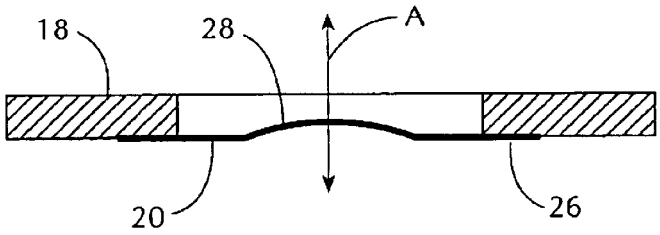
FIG. 2 is an enlarged section view of a piezoelectric actuator and vibratory orifice plate used in the atomization device of FIG. 1.

The configuration of the actuator 18 and the orifice plate 20 is shown in the enlarged section view of FIG. 2. As can be seen the ring-shaped actuator has flat upper and lower surfaces which are metallized with an electrically conductive metal, for example silver or nickel, to form upper and lower electrodes 18*a* and 18*b*. Electrical wires 26 are soldered to these electrodes and supply them with high frequency alternating electrical fields from a battery powered electrical supply system (not shown). These alternating electrical fields cause the piezoelectric material of the actuator 18 to expand and contract in directions perpendicular to the direction of the applied fields. That is, the actuator expands and contracts in radial directions as shown by the double headed arrow A in FIG. 2.

The actuator 18 may be made of any of several different ceramic materials which exhibit a piezoelectric effect. By way of example, the material used for the actuator may be a ceramic material made from a lead zirconate titanate (PZT) or lead metaniobate (PN). The actuator 18 in the illustrated embodiment has an outer diameter of about 0.382 inches (0.970 cm), an inner diameter of about 0.177 inches (0.450 cm) and a thickness of about 0.025 inches (0.0635 cm). However, these particular materials and dimensions are not critical to this invention.

The orifice plate 20 has an outer flange 26 which is fixed to the lower metallized surface of the actuator 18, preferably by soldering with a tin-lead solder, so that the orifice plate extends across the inner diameter of the actuator. The center region of the orifice plate is slightly dome-shaped as shown at 28. The domed center region contains several (for example 85) small orifices which extend through the plate and which are spaced from each other by about 0.005 inches (0.130 mm). The orifices are preferably tapered from the lower to the upper surface of the plate. For dispensing fragrances and insecticides the orifices may taper from a diameter of 107 microns at the bottom surface of the plate to about 7 microns at the upper surface. These dimensions are not critical and the orifice diameters at the upper surface may vary from 3 to 10 microns or more. Again these specific dimensions are given only by way of example.

The orifice plate 20 is preferably made of nickel, although other materials may be used, provided that they have sufficient strength and flexibility to maintain the shape of the orifice plate while being subjected to flexing forces. Some examples of alloys that could be used are nickel-cobalt and nickel-palladium alloys.

The orifice plate 20 may be made by electroforming, with the perforations being formed in the electroforming process. However, the orifice plate may be made by other processes including rolling; and the perforations may be formed later.

As the actuator 18 expands and contracts radially, it alternately squeezes in on and pulls out on the plate 20, causing the flange region 26 of the plate to flex, and its domed center region 28 to move up and down. This causes liquid, which is supplied to the underside of the plate by a liquid delivery system such as a wick, for example, to be drawn up through the orifices in the plate and ejected upwardly in the form of small droplets. By way of example, the actuator 18 is energized to cause the domed center region of the plate to vibrate up and down at a rate of about 120 to 160 kilohertz.

Figure 3:
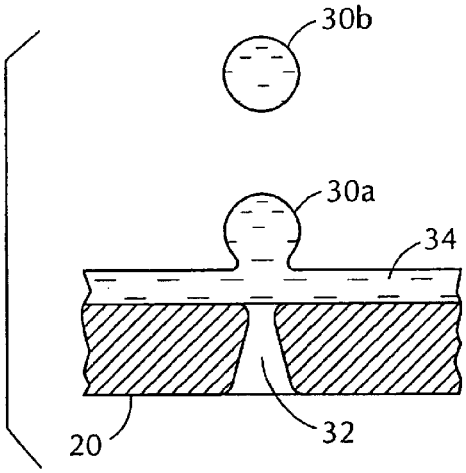
FIG. 3 is a further enlarged fragmentary view showing a portion of a vibratory orifice plate according to the prior art.

In the highly magnified fragmentary cross-section of FIG. 3 a portion of the orifice plate 20 is shown, along with one orifice 32 extending through the plate. The orifice 32 is shown tapered, with its smaller diameter at the upper side of the plate. This tapering provides improved atomization but is not necessary to the present invention. Also, because of the high magnification of FIG. 3, the region where the perforations 32 intersect with the upper and lower surfaces of the plate are shown slightly rounded.

As can be seen in FIG. 3, the liquid 30 which passes through the orifice 32 forms into a bulge 30*a* which, because of the momentum imparted to the liquid by the up and down movement of the plate, breaks away in the form of a droplet 30*b* which is thrown upwardly.

It will be seen that not all of the liquid which passes through the orifice 32 goes to forming the droplet 30*b*. As a result, a portion of the liquid adheres to and wets the upper side of the plate so as to form a liquid layer 34 on the upper surface of the plate. The inventors have found that this liquid layer interferes with droplet formation in a number of ways. First, the inertia of the layer 34 imposes a load which interferes with the up and down movement of the plate, thus reducing the energy available for atomization of the liquid. Secondly, liquid from the layer 34 is added to liquid passing through the orifice 32 which adds to the diameter of the droplet 30*b*. The large droplet, because of its size, cannot be thrown upward as high as a smaller droplet. Finally, the larger droplet requires a larger amount of time to become completely evaporated. As a result a portion of the droplet may fall back on adjacent surfaces in liquid form, This may cause chemical attack on those surface or may just result in a an unsightly appearance on these surfaces.

Figure 4:
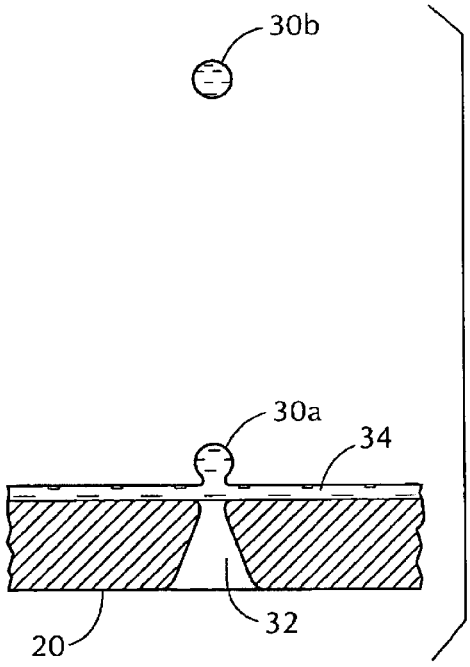
FIG. 4 is a view similar to FIG. 3, showing a portion of a vibratory orifice plate according to the present invention.

FIG. 4 illustrates how the present invention overcomes the above described problem. As can be seen in FIG. 4, little or no liquid remains on the upper surface of the orifice plate 20. Accordingly, the liquid layer 34 in FIG. 4 is significantly thinner than the layer 34 in FIG. 3. As a result the plate 20 can move up and down at maximum amplitude to project droplets to a greater height. Also, because there is less liquid in the layer 34, the bulge 30*a* in FIG. 4 is significantly smaller than the bulge 30*a* in FIG. 3 and the size of the bubble 30*b* in FIG. 4 is determined essentially by the liquid which passes through the orifice 32 during each up and down cycle.

The invention involves preparing the upper surface of the orifice plate 20 so that it is not wetted by the liquid being atomized. It has been found that this wetting can be eliminated or greatly reduced by coating the upper surface of the plate with a coating comprising a surfactant, for example a fluorinated surfactant. Any treatment of the upper surface of the orifice plate 20 to lower wetting or spreading of liquid helps to reduce the size of the droplets that are produced by up and down vibratory movement of the plate. Any chemical which contains a fluorinated group, for example polymers, surfactant, fluorinated silanes, etc., may be used as a coating to reduce wetting of the upper surface of the plate.

Actually, it has been found that because the liquid from which the droplets are formed passes through orifices in an orifice plate (a solid) and into the atmosphere (a gas), which also is in contact with the upper surface of the plate, three interfaces are involved in droplet formation, namely gas/solid (g/s), solid/liquid (s/l) and liquid/gas (l/g). Further the interfacial surface tensions ($\sigma$) between these three phases must be in a particular relationship to minimize the formation of the liquid layer 34 on the upper surface of the plate. Specifically, it has been found that if $$\sigma_{s/g}<\sigma_{s/l}+(\sigma_{l/g}\cos\theta)$$

where $\theta$ is the angle between a line tangent to the surface of the orifice plate 20 and a line tangent to the surface of a droplet being formed on the plate, liquid will not tend to spread along the surface of the plate or to build up the layer 34.

This invention is not limited to the use of a surfactant. Any surface or any surface treatment that has the ability to reduce wetting of the orifice plate and buildup of the layer 34 shown in FIG. 3 will result in a decrease in droplet size.

INDUSTRIAL APPLICABILITY

This invention improves the atomization characteristics of vibratory plate atomizers in a manner such that they use less energy and such that they produce smaller droplets which are ejected higher into the atmosphere, whereupon a greater portion of the liquid is evaporated into the atmosphere and less liquid rains down on adjacent surfaces in liquid form.

What is claimed is:

1. A method of generating droplets of minimal diameter comprising the steps of:

providing a reservoir containing a liquid to be atomized;

providing a vibratory atomization plate having multiple orifices formed therethrough wherein the liquid is ejected as droplets through the orifices;

providing a liquid delivery system including one of a wick and a capillary tube for transporting the liquid to be atomized from the reservoir to the vibratory atomization plate; and treating a surface of said plate from which droplets of the liquid are ejected during atomization with at least one of a surfactant and a chemical containing a fluorinated group, to minimize liquid accumulation on the surface, wherein the liquid is supplied to said plate while vibrating said plate to atomize the liquid.

2. A method according to claim 1, wherein said atomization plate is an orifice plate.

3. A method according to claim 2, wherein the orifices are between 3 and 10 microns at the upper surface of the plate.

4. A method according to claim 3, wherein the orifice plate is made of metal.

5. A method according to claim 1, wherein the surface of the plate is treated with a surfactant.

6. A method according to claim 5, wherein the surfactant is a fluorosurfactant.

7. A method according to claim 1, wherein the surface of the plate is treated with a chemical which contains a fluorinated group.

8. A method according to claim 7 wherein the fluorinated group is selected from the group consisting of polymers, surfactants, and silanes.

9. A method according to claim 1, wherein the plate is vibrated at a frequency in the range of 120 to 100 kilohertz.

10. An atomization device for converting a liquid into droplets of minimum diameter, said device comprising:

a reservoir containing a liquid to be atomized;

an atomization plate coupled to an actuator to be vibrated thereby, said plate having (i) multiple orifices formed therethrough through which the liquid is ejected as droplets and (ii) a surface from which the droplets are ejected, said surface having been treated with at least one of a surfactant and a chemical containing a fluorinated group to minimize accumulation of liquid thereon; and a liquid supply system, including one of a wick and a capillary tube for transporting the liquid to said atomization plate during vibration thereof.

11. An atomization device according to claim 10, wherein said atomization plate is an orifice plate.

12. An atomization device according to claim 11, wherein said liquid supply system supplies liquid to a surface of said plate opposite to that from which liquid droplets are ejected.

13. An atomization device according to claim 11, wherein the orifices are between 3 and 10 microns the upper surface of the orifice plate.

14. An atomization device according to claim 13, wherein said orifice plate is made of metal.

15. An atomization device according to claim 10, wherein said surface of said plate is treated with a surfactant.

16. An atomization device according to claim 15, wherein said surfactant is a flurosurfactant.

17. An atomization device according to claim 10, wherein said surface of said plate has been treated with a chemical which contains a fluorinated group.

18. An atomization device according to claim 17, wherein said fluorinated group is selected from the group consisting of polymers, surfactants and silanes.

19. An atomization device according to claim 10, wherein said plate is vibrated at a frequency in the range of 120 to 160 kilohertz.

* * * * *